US011340556B2

(12) United States Patent
Lauper et al.

(10) Patent No.: US 11,340,556 B2
(45) Date of Patent: May 24, 2022

(54) DIAL MADE OF NON-CONDUCTIVE MATERIAL WITH FEET

(71) Applicant: Comadur SA, Le Locle (CH)

(72) Inventors: Stéphane Lauper, Cortaillod (CH); Lionel Blaser, Corcelles (CH); Alexandre Netuschill, Le Cerneux-Pequignot (CH)

(73) Assignee: Comadur SA, Le Locle (CH)

( * ) Notice: Subject to any disclaimer, the term of this patent is extended or adjusted under 35 U.S.C. 154(b) by 0 days.

(21) Appl. No.: 17/118,450

(22) Filed: Dec. 10, 2020

(65) Prior Publication Data

US 2021/0173343 A1 Jun. 10, 2021

(30) Foreign Application Priority Data

Dec. 10, 2019 (EP) ..... 19214648

(51) Int. Cl.
*G04B 19/12* (2006.01)
*G04B 19/06* (2006.01)
*G04B 19/14* (2006.01)

(52) U.S. Cl.
CPC ..... *G04B 19/12* (2013.01); *G04B 19/065* (2013.01); *G04B 19/14* (2013.01)

(58) Field of Classification Search
CPC ..... G04B 19/065; G04B 19/12; G04B 19/14
See application file for complete search history.

(56) References Cited

U.S. PATENT DOCUMENTS 419,525 A * 1/1890 Ide ..... G04B 19/14 368/237
1,400,421 A * 12/1921 Colomb ..... G04B 19/14 368/237
1,995,036 A * 3/1935 Pape ..... G04B 19/14 368/236
2,575,213 A * 11/1951 Fruth ..... F16B 19/04 411/80.1
3,848,389 A * 11/1974 Gapp ..... F16B 19/06 411/504
3,924,791 A * 12/1975 Shimizu ..... G04B 19/12 228/110.1

(Continued)

FOREIGN PATENT DOCUMENTS

CH 33698 A 12/1905
CH 85752 A 7/1920

(Continued)

OTHER PUBLICATIONS

Notice of Grounds for Rejected dated Dec. 8, 2020 in Korean Patent Application No. 10-2020-0165749, (with English translation), 7 pages.

(Continued)

*Primary Examiner* — Daniel P Wicklund
(74) *Attorney, Agent, or Firm* — Oblon, McClelland, Maier & Neustadt, L.L.P.

(57) ABSTRACT

A dial configured to be mounted in a watch case, includes a plate made of a fragile material, the plate defining a horizontal plane and including at least one housing defining a point of attachment for at least one foot formed of a body and a head arranged to rest inside the at least one housing, the foot includes a circular slot arranged to receive a ring-like element made of a shape memory alloy able to move from a retracted position to an open position in which the foot is mechanically held in the housing.

8 Claims, 2 Drawing Sheets

(56) References Cited

U.S. PATENT DOCUMENTS

| | | | | |
|---|---|---|---|---|
| 4,150,538 | A * | 4/1979 | Nakayama | G04B 37/05 368/299 |
| 4,291,401 | A * | 9/1981 | Bachmann | G04B 19/14 368/236 |
| 8,388,292 | B2 * | 3/2013 | Kirkwood | F16B 1/0014 411/351 |
| 9,657,762 | B2 * | 5/2017 | Neal | B29C 70/82 |
| 2019/0146418 | A1 * | 5/2019 | Junod | G04B 37/05 368/297 |

FOREIGN PATENT DOCUMENTS

| | | | |
|---|---|---|---|
| CH | 352962 | A | 3/1961 |
| CH | 696987 | A5 | 2/2008 |
| CH | 697052 | A5 | 3/2008 |
| CN | 1648792 | A | 8/2005 |
| CN | 203743428 | U | 7/2014 |
| CN | 110178093 | A | 8/2019 |
| CN | 110231769 | A | 9/2019 |
| CN | 1100442008 | A | 11/2019 |
| EP | 1538493 | A1 | 6/2005 |
| JP | 56-55881 | A | 5/1981 |

OTHER PUBLICATIONS

European Search Report dated May 18, 2020 in European Application No. 19 21 4648, (with English translation), 9 pages.
Chinese Office Action issued in Chinese Patent Application No. 202011346848.1 dated Oct. 18, 2021.

* cited by examiner

DIAL MADE OF NON-CONDUCTIVE MATERIAL WITH FEET

CROSS-REFERENCE TO RELATED APPLICATIONS

The present application claims the benefit of priority from prior European Application No. 19214648.8 filed Dec. 10, 2019.

FIELD OF THE INVENTION

The invention concerns a dial made of fragile material and with feet for timepieces. The invention also concerns a method for making such a dial.

The invention also concerns a watch case comprising a dial made of fragile material.

The invention also concerns a watch including the watch case.

STATE OF THE ART

Watch dials can be made of fragile materials such as ceramic, mother-of-pearl, aventurine, etc. which have an attractive aesthetic appearance but which have the drawback of having a high thickness due to the need to add a support comprising the feet, of requiring numerous assembly steps and of being fragile.

In a conventional structure, the dial comprises two plates bonded one atop the other with a support plate made of a metal material such as brass, and a plate which is visible through the crystal and made of the fragile material in question. In this construction, the support plate also has feet for positioning the dial.

There are also known 'sandwich' dials with feet, as described, for example, in Swiss Patent No. CH352962. The feet are welded to a first metal plate onto which is welded or adhesive bonded a second metal plate, forming the visible face of the dial comprising hour symbols in relief, but no particular coating.

There is also known from European Patent No EP1538493 an enamelled dial with positioning feet consisting of a first ceramic element assembled to a second element to which at least one foot is attached, characterized in that the external surface of said first element is coated with one to two enamel layers and in that the second element is provided with at least one housing allowing attachment of a foot by press fit and/or adhesive bonding prior to the assembly of the first and second elements by a glue or weld joint.

It is therefore an object of the present invention to overcome the drawbacks of the prior art by providing a thinner dial made of fragile material and a method for making a dial with mounted feet which has a smaller number of steps.

SUMMARY OF THE INVENTION

It is therefore an object of the invention to provide a dial made of fragile material whose size is identical to a conventional arrangement, but from which the metal plate is removed for the purpose of thickening the plate of fragile material in order to make it stronger.

To this end the invention concerns a dial intended to be mounted in a watch case, the dial comprising a plate made of a fragile material, said plate defining a horizontal plane and comprising at least one housing defining a point of attachment for at least one foot formed of a body and a head arranged to rest inside said at least one housing, characterized in that the foot includes a circular slot arranged to receive a ring-like element made of a shape memory alloy able to move from a retracted position to an open position in which the foot is mechanically held in said housing.

Specific embodiments of the dial are defined in the dependent claims 2 to 6.

To this end, the invention also concerns a watch case comprising a dial as defined in claims 1 to 6.

To this end, the invention also concerns a watch including the watch case described above.

BRIEF DESCRIPTION OF THE DRAWINGS

The objects, advantages and features of the dial according to the invention will appear more clearly in the following description, based on at least one non-limiting embodiment illustrated by the drawings, in which.

DETAILED DESCRIPTION OF THE INVENTION

Figure 1:
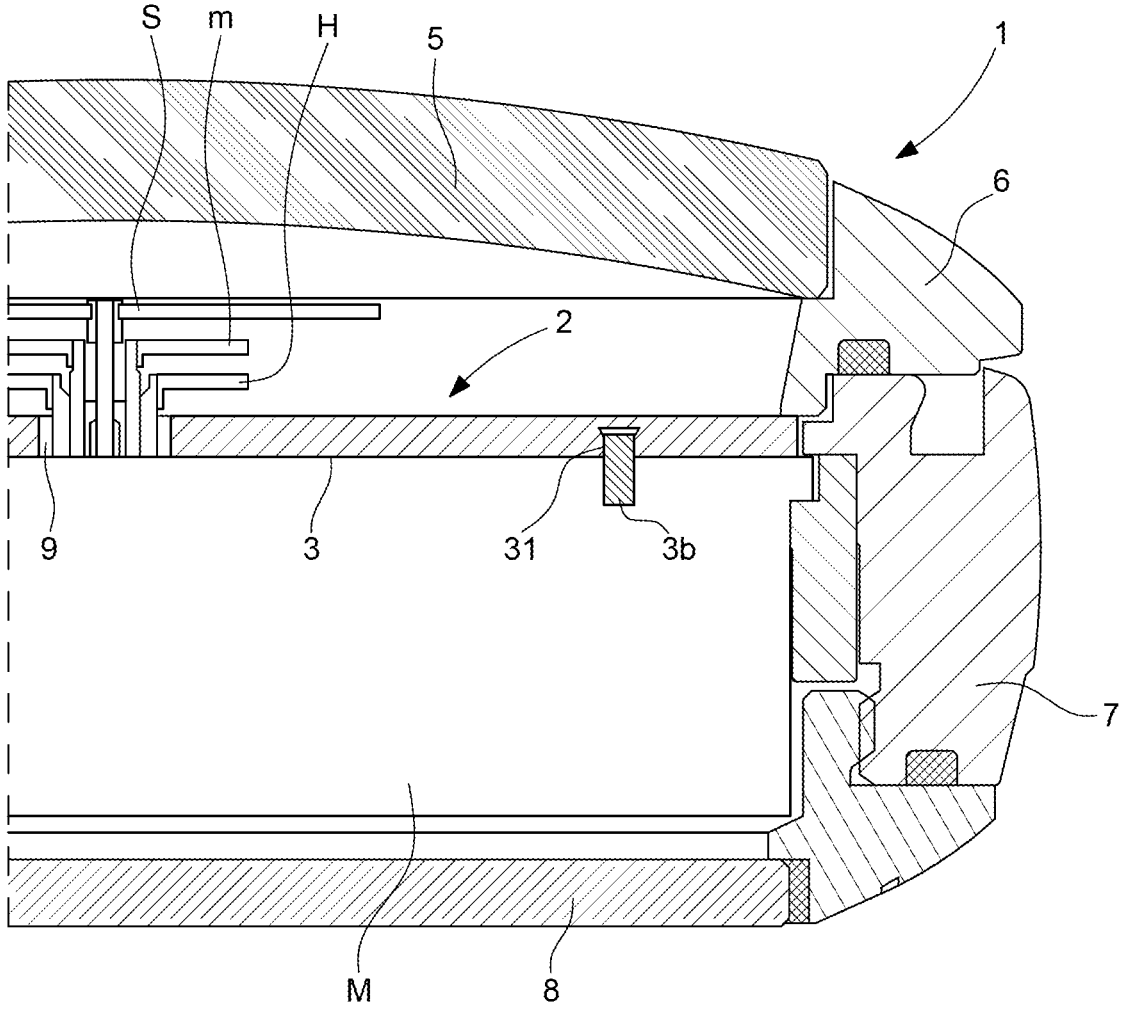
FIG. 1 is a sectional view of a watch case provided with a dial according to the embodiment of the invention.

The present invention relates to a dial construction arranged to be mounted in a watch case comprising a timepiece movement M, on which is mounted a dial 2, above which hour hand H, minute hand M and seconds hand S move, driven by movement M. Referring to FIG. 1, dial 2 comprises a plate 3 made of the fragile material. A 'fragile material' means any material liable to break/crack following a machining operation or under the effect of a shock. For example, to name a few, the fragile material may be ceramic, quartz in one of its varieties which is aventurine, sapphire, mother-of-pearl, silicon, etc.

In a conventional manner, watch case 1 comprises a crystal 5, a back cover 8 and a joining element between crystal 5 and back cover 8 made in one or more pieces and including a bezel 6 and a case middle 7. The front side of fragile plate 3 is oriented towards crystal 5 and the back side of the plate is oriented towards back cover 8 of watch case 1, plate 3 forming the dial defining a horizontal plane. In a conventional manner, plate 3 is pierced with at least one orifice 9 for the passage of the hand arbor 10.

On the back side, plate 3 forming the dial has at least one housing 3*a* in which is arranged a foot 3*b*, the housing defining a point of attachment for the foot. In a conventional manner, the foot comprises a body and a head arranged to rest inside said at least one housing, the foot taking the form of a cylinder of revolution, the head and the body of the foot having an identical diameter.

Housing 3*a* of dial 2 can be made by any suitable means, such as machining, milling, laser ablation, or straight in the mould of the support. For example, in the case of a ceramic support, the hollow can be obtained by machining or laser ablation of the raw ceramic, the hollowed support being then fired and densified.

According to the invention, foot 3*b* has a circular slot 30 on its head, arranged to receive a ring-like element 31 made of a first shape memory alloy. Ring-like element 31 is able to move from a first position, called the retracted position in which it rests inside the slot, to a second position, called the rest position, in which ring-like element 31 returns to its original shape and at least partly protrudes from annular slot 30 so that it is in contact with the walls of the housing and mechanically holds the foot inside the housing. The ring-like element is made of a shape memory alloy, such as a nickel and titanium alloy known by the name of Nitinol.

Ring-like element 3 can take the form of a star with eight rounded points 30. This geometry ensures better deformation of ring-like element 3 compared to an annular ring-like element, since ring-like element 3 according to the invention has a smaller cross section than an annular ring-like element.

Another advantage of such a geometry is that several points of contact are obtained with wall of housing 3*a*, which makes it possible to apply greater force to a smaller surface area and thereby ensure good retention.

Those skilled in the art will have no particular difficulty in adapting the shape of the ring-like element to obtain similar effects, the number of rounded points of the star could be decreased or increased to obtain stars with five, six or nine rounded points, for example.

Figure 2:
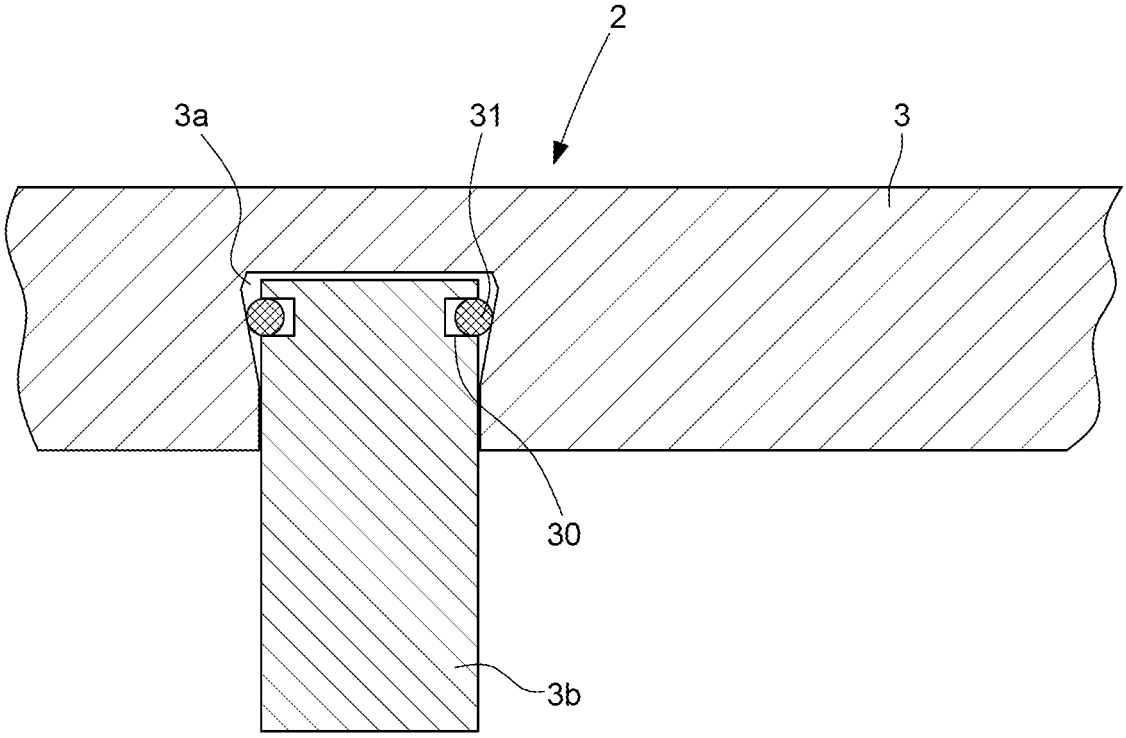
FIG. 2 is a sectional view of the dial of FIG. 1.
Figure 3:
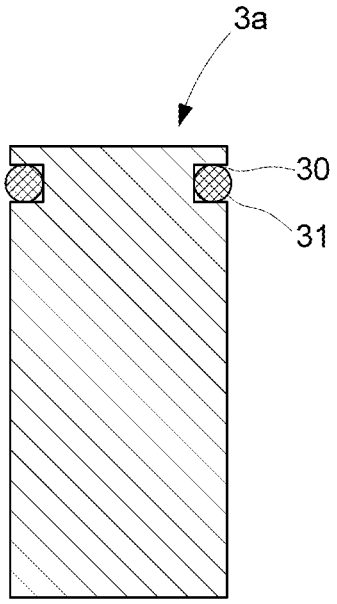
FIG. 3 is a sectional view of a dial foot according to the invention.

As can be observed in FIG. 2, the housing has an aperture opening onto one of the faces of plate 3, in this case the back side, and comprises a first portion in immediate proximity to the aperture, called the upper portion and having a cylindrical cross-section, and a second portion, called the lower portion, having a truncated cross-section.

In an advantageous manner, housing 3*a* has a slight taper, the surface of a cross-section of the housing increasing slightly with depth thereof, the housing then having a slightly inclined wall in order to increase the space between the foot and the inclined wall of the housing and to allow easier deformation of ring-like element 31 and more efficient mechanical anchoring of the foot.

According to the invention, the depth of housing 3*a* is smaller than the thickness of the plate forming the dial and substantially greater than the height of the head of the foot so that the foot is well retained.

The invention claimed is:

1. A dial intended to be mounted in a watch case, the dial comprising a plate made of a fragile material, said plate defining a horizontal plane and comprising at least one housing defining a point of attachment for at least one foot consisting of a body and a head arranged to rest inside said at least one housing, characterized in that the head of the foot includes a circular slot arranged to receive a ring-like element made of a shape memory alloy able to move from a retracted position in which the ring-like element rests in the slot, to a rest position in which the foot is mechanically held inside said housing.

2. A dial according to claim 1, characterized in that the housing has an aperture opening onto one of the faces of the plate and comprises a first portion, called the upper portion, having a cylindrical cross-section, and a second portion, called the lower portion, having a truncated cross-section.

3. A dial according to claim 1, characterized in that the depth of the housing is smaller than the thickness of the plate forming the dial and is substantially greater than the height of the head of the foot so that the foot is well retained.

4. A dial according to claim 1, characterized in that said ring-like element is made of an alloy of nickel and titanium.

5. A dial according to claim 1, characterized in that the housing has a complementary shape to that of the foot.

6. A dial according to claim 1, characterized in that the plate forming the dial is made of a fragile material selected from the list including ceramic, mother-of-pearl, aventurine, sapphire and silicon.

7. The watch case comprising the dial according to claim 1, the case being provided with a back cover, with a crystal and with a joining element between the back cover and the crystal made in one or more pieces and comprising a case middle.

8. A watch comprising a case delimiting a space inside which is mounted the dial according to claim 1.

* * * * *